US006953011B2

(12) United States Patent
Geyer et al.

(10) Patent No.: US 6,953,011 B2
(45) Date of Patent: Oct. 11, 2005

(54) TWO-CYCLE ENGINE

(75) Inventors: Werner Geyer, Berglen (DE); Claus Fleig, Ludwigsburg (DE); Jörg Schlossarczyk, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/439,035

(22) Filed: May 15, 2003

(65) Prior Publication Data

US 2003/0217709 A1 Nov. 27, 2003

(30) Foreign Application Priority Data

May 24, 2002 (DE) ..... 102 23 070

(51) Int. Cl.[7] ..... F02B 33/04
(52) U.S. Cl. ..... 123/73 PP
(58) Field of Search ..... 123/73 PP, 73 A, 123/73 R, 65 A

(56) References Cited

U.S. PATENT DOCUMENTS

| | | | | |
|---|---|---|---|---|
| 6,367,432 | B1 | 4/2002 | Araki | |
| 6,497,204 | B1 * | 12/2002 | Miyazaki et al. | 123/73 PP |
| 6,571,756 | B1 * | 6/2003 | Rosskamp et al. | 123/73 PP |
| 6,708,958 | B1 * | 3/2004 | Warfel et al. | 261/45 |
| 2002/0043227 | A1 | 4/2002 | Carlsson et al. | |

FOREIGN PATENT DOCUMENTS

| | | | |
|---|---|---|---|
| EP | 1 069 294 | 10/1999 | |
| EP | 0 992 660 | 4/2000 | |
| JP | 2001323816 | 11/2001 | |
| JP | 2001329844 | 11/2001 | |
| JP | 2001-329844 | * 11/2001 | ..... F02B/25/22 |
| WO | WO 00/43650 | 7/2000 | |
| WO | WO 01/51782 | 7/2001 | |

* cited by examiner

*Primary Examiner*—Henry C. Yuen
*Assistant Examiner*—Hyder Ali
(74) *Attorney, Agent, or Firm*—Robert W Becker & Associates; Robert W Becker

(57) ABSTRACT

A two-cycle engine, especially for a portable, manually-guided implement, is provided. The engine has a cylinder with a combustion chamber delimited by a reciprocating piston. An inlet opens into the cylinder for supplying fuel/air mixture into a crankcase. The engine has an outlet for exhaust gases from the combustion chamber and at least one transfer channel, which, in prescribed positions of the piston, fluidically connects the crankcase with the combustion chamber. The engine has a clean air path that includes an air channel, a piston window and a transfer channel. In prescribed positions of the piston the air channel is fluidically connected via the piston window with an inlet window of the transfer channel. The direction of flow in the clean air path from inlet to outlet extends uniformly, in at least one piston position, and in a plane that extends perpendicular to the longitudinal axis of the cylinder.

22 Claims, 5 Drawing Sheets

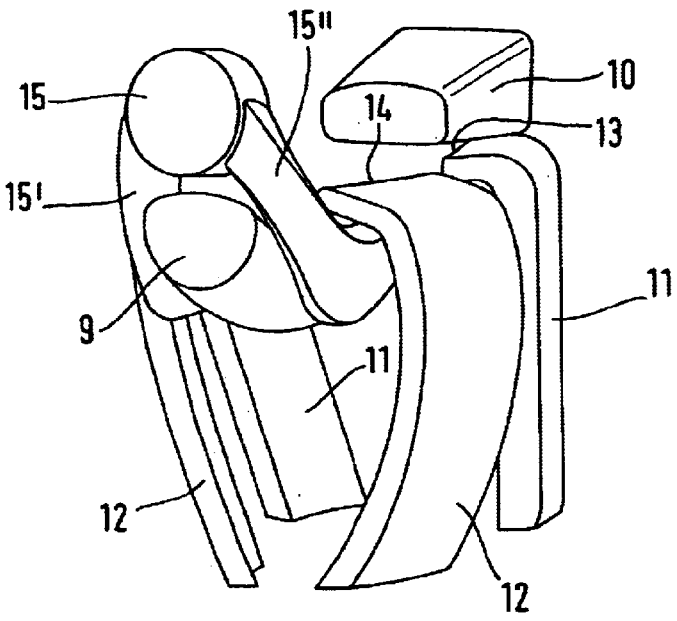
Fig. 4
Fig. 5
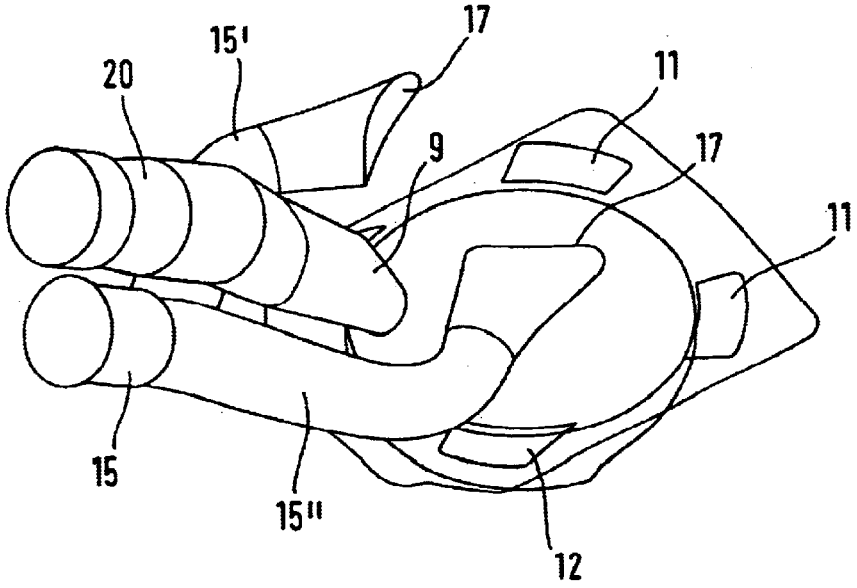

TWO-CYCLE ENGINE

BACKGROUND OF THE INVENTION

The present invention relates to a two-cycle engine, especially in a portable, manually guided implement, such as a chain saw, a cut-off machine, or the like.

WO 00/43650 discloses a two-cycle engine that has an air channel for the supply of air into the transfer channel. The air channel is connected with the transfer channel via a piston window. The fresh air previously collected in the transfer channels is frequently not sufficient for a clean separation of exhaust gases and fresh fuel/air mixture that is flowing in from the crankcase. As a result, increased scavenging losses and hence poor exhaust gas values can occur.

It is therefore an object of the present invention to provide an improved two-cycle engine of the aforementioned general type that, while providing a good scavenging result, minimizes the scavenging losses.

BRIEF DESCRIPTION OF THE DRAWINGS

This object, and other objects and advantages of the present invention, will appear more clearly from the following specification in conjunction with the accompanying schematic drawings, in which:

FIG. 4 is a perspective illustration showing intake channel, air channel, transfer channels and the outlet;

FIG. 5 is a perspective view of the intake channel, air channel and outlet;

SUMMARY OF THE INVENTION

Figure 1:
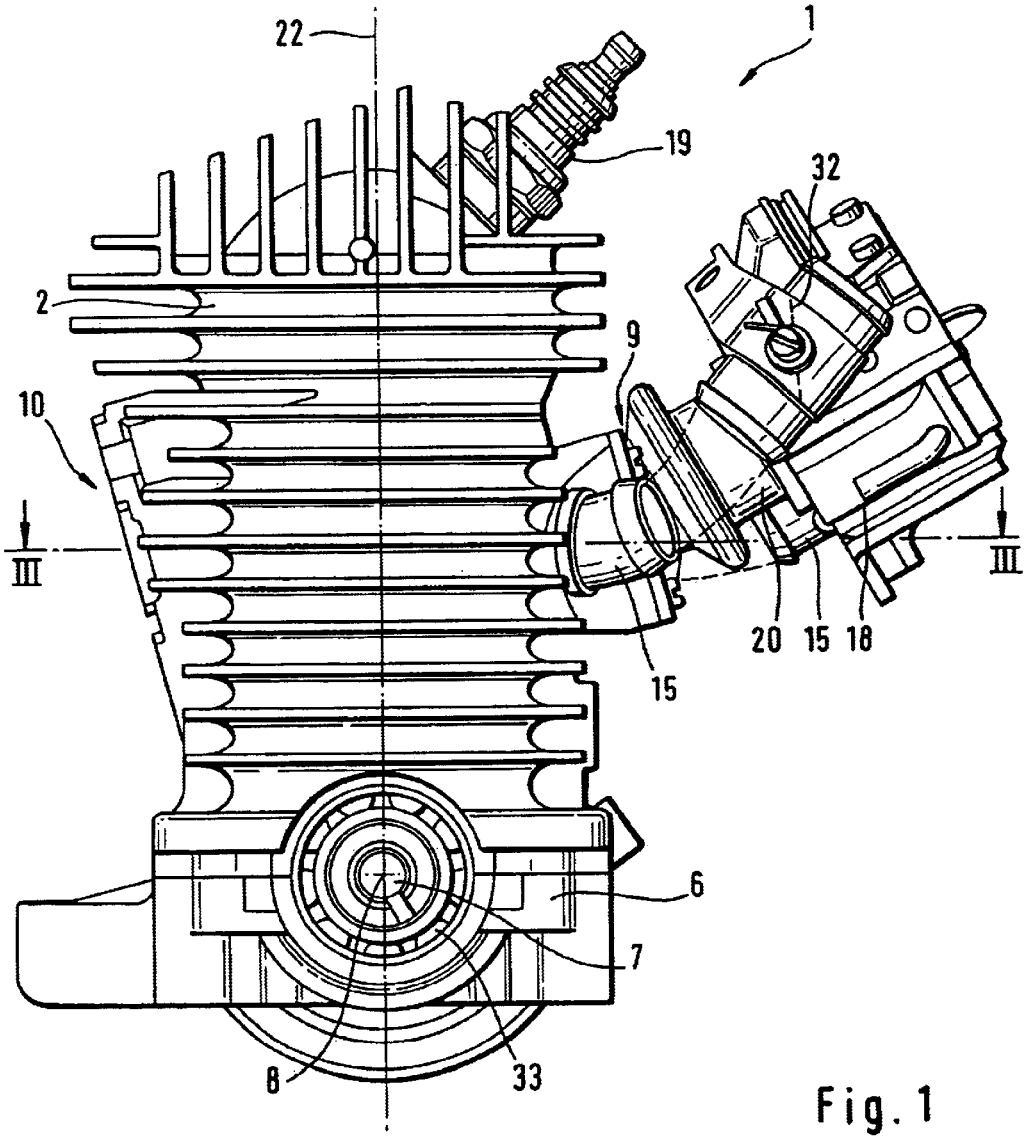
FIG. 1 shows a side view of a two-cycle engine.

The two-cycle engine of the present invention in which is formed a combustion chamber that is delimited by a reciprocating piston that, via a connecting rod, drives a crankshaft that is rotatably mounted in a crankcase, wherein an inlet is provided for a supply of fuel/air mixture into the crankcase, wherein an outlet is provided for discharge of exhaust gas from the combustion chamber, wherein at least one transfer channel is provided for fluidically connecting the crankcase with the combustion chamber in prescribed positions of the piston, wherein the transfer channel opens into the combustion chamber via an inlet window, wherein a clean air path is provided that includes an air channel, a piston window, and a transfer channel, whereby the air channel serves for conveying essentially fuel-free air and, in prescribed positions of the piston, is fluidically connected via the piston window with the inlet window of the transfer channel, and wherein for a good filling of the transfer channels with fresh air to achieve a good scavenging result, it is provided that the direction of flow in the clean air path extends substantially uniformly from the inlet into the cylinder to the outlet out of the piston window, in at least one position of the piston, and in a plane that extends perpendicular to the longitudinal axis of the cylinder. The avoidance of sharp turns or deflections prevents turbulence and thus enables a good filling of the transfer channels. The direction of flow from the inlet into the cylinder to the outlet out of the piston window expediently extends uniformly in every piston position in which transfer channel and air channel are connected via the piston window.

The change of the direction of flow in the clean air path advantageously extends uniformly from the inlet into the cylinder to the outlet out of the piston window in a plane that extends perpendicular to the longitudinal axis of the cylinder. It has been shown to be advantageous for a good filling of the transfer channels if the clean air path from the inlet into the cylinder to the outlet out of the piston window is curved in one direction in a plane that extends perpendicular to the longitudinal axis of the cylinder. The avoidance of changes of the direction of curvature avoids turbulence and leads to a uniform flow therethrough. In particular, the radius of curvature of the clean air path from the inlet into the cylinder to the outlet out of the piston window is approximately constant in at least one piston position in a plane that extends perpendicular to the longitudinal axis of the cylinder.

The rear wall of the piston window expediently extends parallel to the longitudinal axis of the cylinder. The flow through conditions through the piston window are thus largely the same for all the positions in which the air channel is fluidically connected with the transfer window. Expediently, in at least one piston position, in a plane that extends perpendicular to the longitudinal axis of the cylinder, one wall of the portion of the clean air path that is formed in the cylinder merges tangentially into the rear wall of the piston window. The wall advantageously merges tangentially into the rear wall of the piston window over a wide range of the piston positions in which air channel and transfer channels are fluidically connected with one another. The overall volume of the piston window is advantageously 4 to 14% of the stroke volume or piston displacement of the two-cycle engine. A streamlined arrangement results if the flow resistance from the inlet into the cylinder to the inlet window of the transfer channel or channels is approximately constant in at least one position of the piston. The rear wall of the piston window that is contiguous to the longitudinal axis of the cylinder advantageously has a concave configuration in the circumferential direction of the piston. This allows a favorable flow cross-section to be achieved in the piston window for reducing the flow resistance. At the same time, there results a favorable course of the direction of flow.

For a good deflection of the flow direction in the piston window, it is provided that the radius of curvature of the rear wall of the piston window be at least 70% of the diameter of the piston, and in particular one to nine times the diameter of the piston. As a consequence of the large radius relative to the piston diameter, a sharp deflection of the fluid stream in the piston window is avoided. For a low flow resistance, it is provided that the depth of the piston window be 10 to 40%, especially 13 to 25%, of the piston diameter. The width of the piston window is advantageously 50 to 95%, especially 70 to 85%, of the piston diameter.

For favorable control times, especially a relatively long connection of air channel and transfer channel, it is provided that the height of the piston window, in the region of the air channel window, be two to three times the height of the air channel window. The height of an inlet window is advantageously 10 to 50%, especially 25 to 5%, of the height of the piston window in the region of the air channel window. The entire clean air path is advantageously streamlined, i.e. is embodied with few deflections. For this purpose, advantageously two air channels lead to the cylinder, whereby when viewed in the direction of flow the air channels extend skewed relative to one another at the level of a carburetor. In this way, there results a favorable arrangement by means of which sharp deflections are avoided in the air channels. However, it can also be advantageous that one air channel leads from the air filter to the cylinder, with this air channel being divided into two branches in the region of the cylinder, whereby the direction of flow in each branch extends approximately tangential to the direction of flow in the cooperative section. To form a constant fuel/air mixture, the air channel is expediently provided with a throttle or flow control element, that, when viewed in the direction of flow, is disposed approximately at the level of a carburetor.

Further specific features of the present invention will be described in detail subsequently.

DESCRIPTION OF PREFERRED EMBODIMENTS

Referring now to the drawings in detail, FIG. 1 shows a two-cycle engine 1 having a cylinder 2 and a crankcase 6. The crankshaft 7 is rotatably mounted in the crankcase 6, via a bearing means 33, about the crankshaft axis 8. The intake channel 20 guides fuel/air mixture to the crankcase 6 via an inlet 9. This mixture is prepared in a carburetor 18, whereby a portion of the intake channel 20 is formed in the carburetor. Extending on both sides of the intake channel 20 are air channels 15 that supply air to the two-cycle engine 1 in a largely fuel-free manner. Approximately at the level of the carburetor 18, the two air channels 15 extend in a skewed manner relative to one another. In the air channels 15, at the level of the carburetor 18, respective throttle or flow control elements 32 are disposed that in particular are embodied as air valves or chokes and permit control of the air supply to the two-cycle engine 1.

Figure 6:
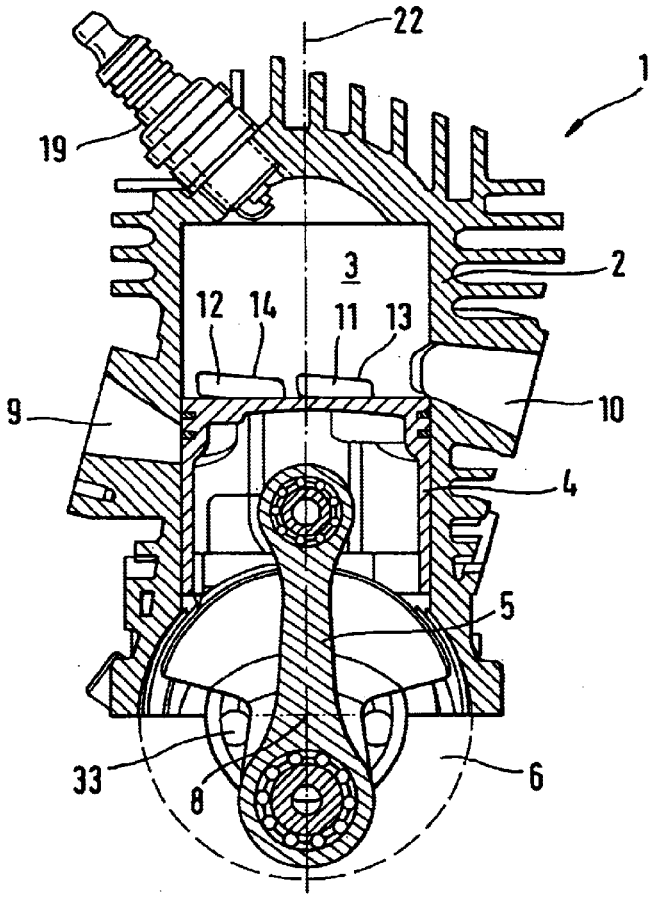
FIG. 6 is a cross-sectional view through a two-cycle engine.

As illustrated in the cross-sectional view of FIG. 6, formed in the interior of the cylinder 2 is a combustion chamber 3 that is delimited by a reciprocating piston 4. The piston 4, via a connecting rod 5, drives the crankshaft 7. In FIG. 6, the lower half shell of the crankcase 6 is indicated by dashed lines. Fuel/air mixture flows via the inlet 9 into the crankcase 6 when the piston 4 is disposed in the vicinity of the upper dead center position. During movement of the piston 4 away from the combustion chamber 3 in the direction of the longitudinal axis 22 of the cylinder toward the crankcase 6, the fuel/air mixture is compressed in the crankcase 6. During further movement of the piston away from the combustion chamber 3, the transfer channels 11,12 open to the combustion chamber. The transfer channels 11, 12 th-1Xen establish a fluidic connection between the crankcase 6 and the combustion chamber 3. The two-cycle engine 1 has two transfer channels 11 that are near the outlet 10 and that open via inlet windows 13 into the combustion chamber 3, and furthermore has two transfer channels 12 that are remote from the outlet 10 and that open into the combustion chamber 3 via inlet windows 14. When the transfer channels 11, 12 are open to the combustion chamber 3, the fuel/air mixture flows out of the crankcase 6 into the combustion chamber 3. There, in the region of the upper dead center position, the fuel/air mixture is ignited by the spark plug 19. During the subsequent movement away of the piston, the outlet 10 out of the combustion chamber 3 is opened and the exhaust gases flow out of the combustion chamber, while already fresh fuel/air mixture flows in out of the transfer channels 11,12.

Figure 2:
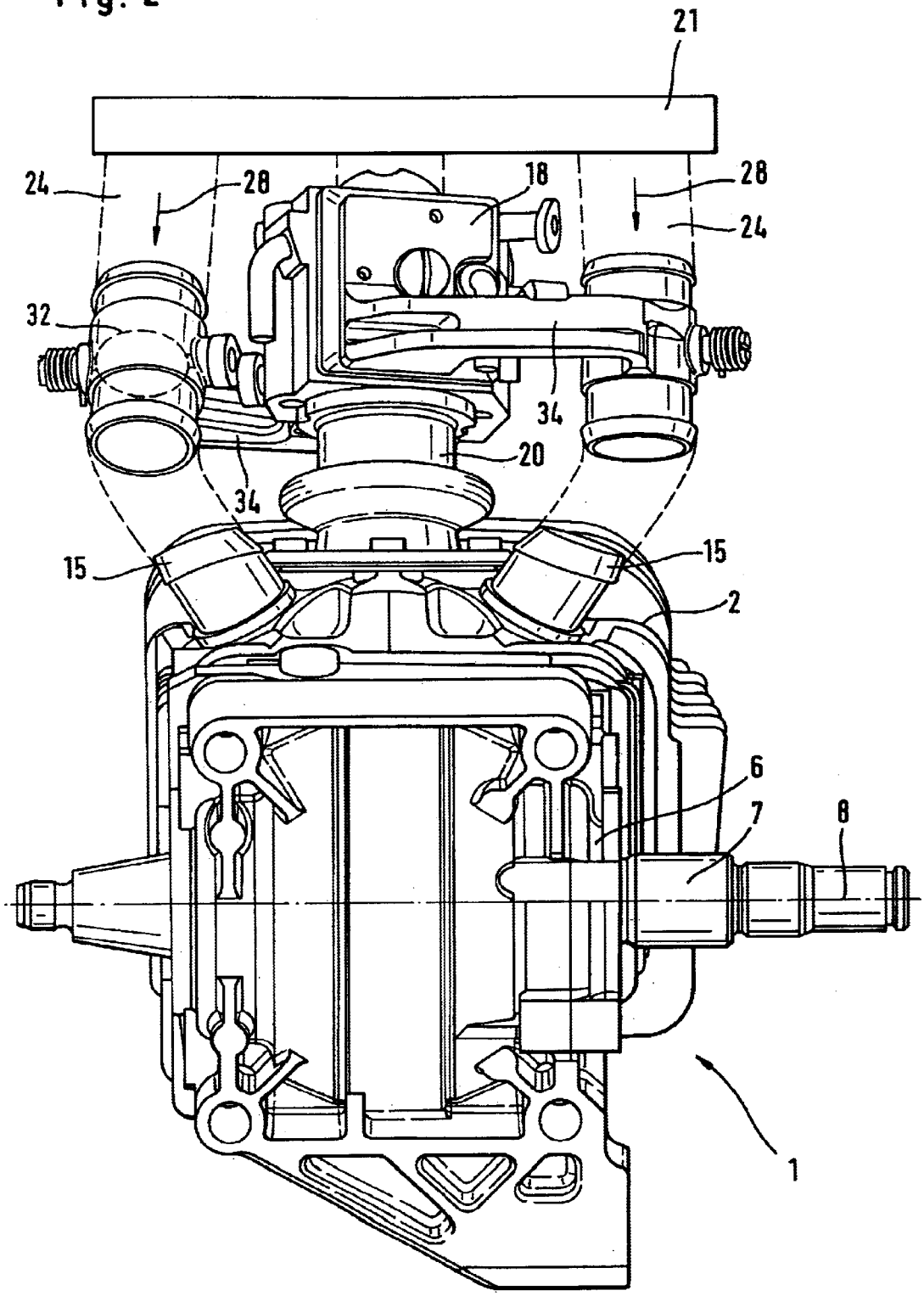
FIG. 2 is a perspective view of the two-cycle engine onto the crankcase and the carburetor.

In the perspective view of the two-cycle engine 1 in FIG. 2, the arrangement of the two air channels 15 on both sides of the intake channel 20 is illustrated. Each air channel forms a portion of the clean air path 24 from the air filter 21, which is schematically illustrated in FIG. 2, to the inlet in the cylinder 2. The intake channel 20 is partially formed in a carburetor 18. At the level of the carburetor 18, disposed in the air channels 15 are flow control elements 32 via which the quantity of air that is supplied can be controlled. The sections of the air channels 15 that include the flow control elements 32 are fixed in position on the carburetor 18 via arms 34. The crankshaft 7 extends approximately perpendicular to the direction of flow into the air channels 15 and the intake channel 20, and extends through the crankcase 6.

Figure 3:
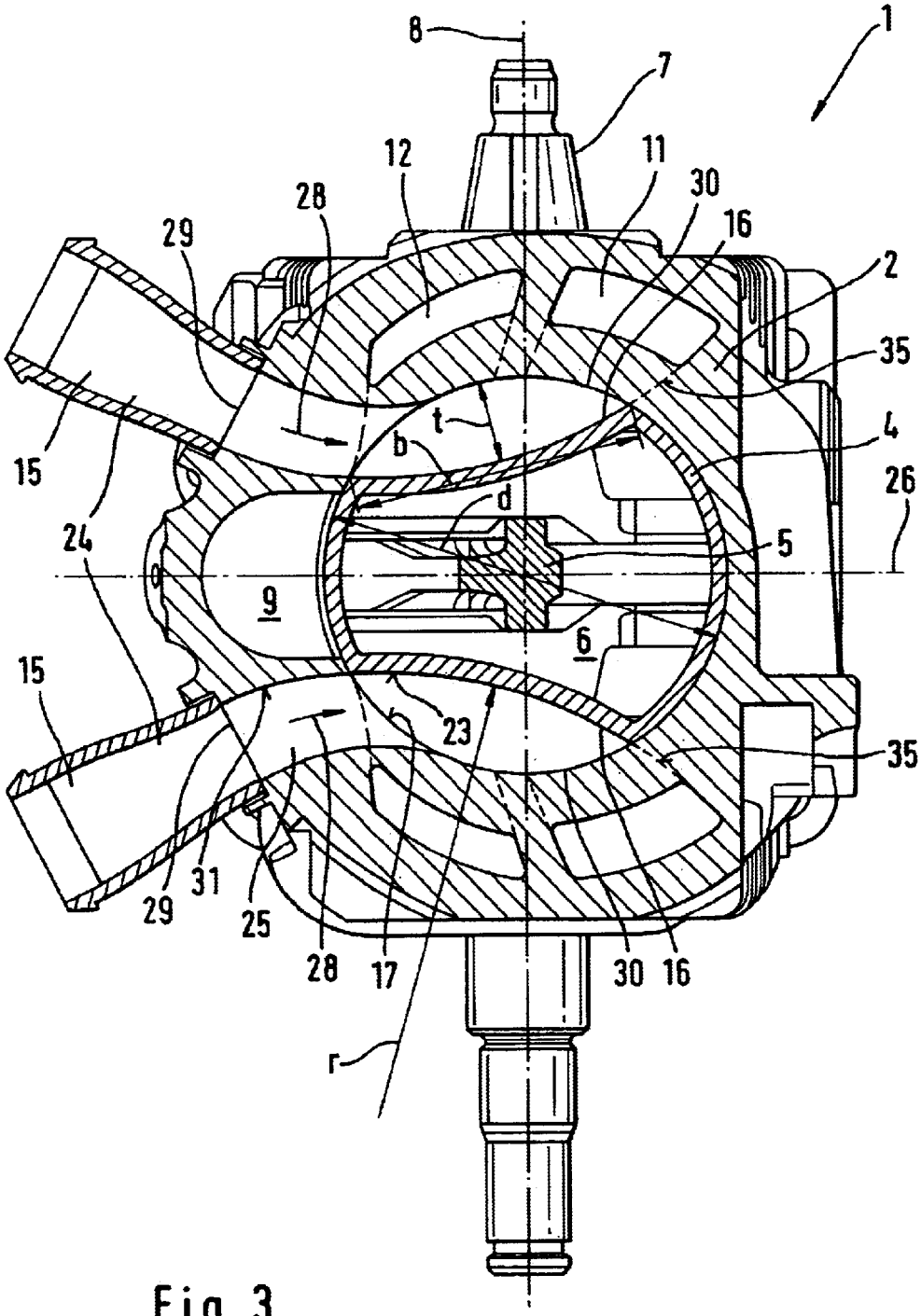
FIG. 3 is a cross-sectional view through the two-cycle engine taken along the line III—III in FIG. 1.

In the cross-sectional view of FIG. 3, at the level of the air channels 15, the piston 4 is illustrated in a position in which the air channels 15 are fluidically connected with the transfer channels 11 and 12 via a piston window 16. The portions of the transfer channels 11 and 12 that open into the combustion chamber 3 extend, as viewed from the plane of the drawing sheet, above the illustrated section and are therefore shown by dashed lines. The connecting rod 5, via which the piston 4 drives the crankshaft 7 that is mounted in the crankcase 6, is shown in section. The two transfer channels 11 that are near the outlet, the two transfer channels 12 that are remote from the outlet, the two piston windows 16, and the portion 25 of the clean air path 24 formed in the cylinder 2 are respectively symmetrically disposed relative to the central plane 26. The central plane 26 extends perpendicular to the axis 8 of the crankshaft 7 and approximately centrally divides the inlet 9 and the outlet 10, the latter not being illustrated in FIG. 3.

The piston windows 16 have a concave configuration, whereby the rear wall 23 of the piston window 16, which rear wall faces the longitudinal axis 22 of the cylinder, has a radius of curvature r. The radius of curvature r can be constant over the entire rear wall 23. However, it can also be advantageous for the rear wall 23 to be formed from adjoining partial sections having different radii of curvature, which advantageously merge into one another, whereby the radii of curvature are in particular sequentially arranged in an increasing or decreasing manner. It can also be expedient to have sections with largely the same radii of curvature yet offset center points of the curvature.

The portion 25 of the clean air path 24 formed in the cylinder 2 opens at the air channel window 17 into the interior of the cylinder 2. That wall 31 of the portion 25 that is contiguous to the center plane 26 merges tangentially at the air channel window 17 into the rear wall 23 of the piston window 16. The wall 35 of the transfer channel 11 that is near the outlet, which wall 35 is also near the outlet, adjoins, on the opposite side of the piston window 16, the rear wall 23 in a tangential manner. The wall 35 that is near the outlet is thereby that wall of the transfer channel 11 that extends in an approximately radial direction approximately parallel to the longitudinal axis 22 of the cylinder.

The direction of flow 28 in the clean air path 24 extends uniformly from the inlet 29, where the air channel 15 opens into the portion 25 formed in the cylinder 2, to the outlet 30 in the region below the inlet window 13 of the transfer channel 11. In this connection, the term below denotes displaced in a direction toward the crankcase 6. As illustrated in FIG. 2, the direction of flow 28 also extends uniformly in the air channels 15 from the air filter 21 to the inlet 29 into the cylinder 2. The clean air path 24 is curved in one direction from the inlet 29 to the outlet 30. In this connection, the curvature corresponds approximately to the radius of curvature r of the rear wall 23 of the piston window 16. The radius of curvature is approximately constant from the inlet 29 to the outlet 30. However, it can also be advantageous for the change of the direction of flow to extend uniformly and in particular to be constant. The radius of curvature r can continue up to and into the air channel 15. However, it can also be advantageous for the air channel 15 to extend linearly. The air channel 15 expediently tangentially joins the portion 25 with the same diameter.

The resistance to flow in the clean air path 24 is, in at least one position of the piston, advantageously approximately constant over the entire length of the clean air path from the air filter 21 up to the opening out of the transfer channels 11, 12 into the crankcase 6, at least however from the inlet 29 into the cylinder 2 up to the inlet windows 13,14 into the transfer channels 11, 12. The rear wall 23 of the piston window 16 extends parallel to the longitudinal axis 22 of the cylinder. Favorable flow conditions result if the radius of curvature r of the rear wall 23 of the piston window 16 is at least 70% of the diameter d of the piston 4. In particular, the radius of curvature r is one to nine times the diameter d of the piston 4. As a consequence of the large curvature r, a uniform direction of flow is ensured.

In order to be able to realize a low resistance to flow, it is provided that the depth t of the piston window 16, as measured in a radial direction relative to the longitudinal axis 22 of the cylinder, is 10 to 40%, especially 13 to 25%, of the diameter d of the piston 4. The width b of the piston window is 50 to 95%, especially 70 to 85%, of the diameter d of the piston. The overall volume of the piston window 16 is 4 to 14% of the stroke volume or piston displacement of the two-cycle engine 1, i.e. the difference between the volume of the combustion chamber 3 in the lower dead center position of the piston 4 and the volume of the combustion chamber 3 in the upper dead center position of the piston 4. The volume of the piston window 16 should be selected such that the flow resistance in the piston window 16 is not less than it is in other portions of the clean air path 24. The flow cross-section in the transfer channel 11 that is close to the outlet is greater than the flow cross-section in the transfer channel 12 that is remote from the outlet. The flow cross-sections in the transfer channels 11,12 are approximately constant over the length of the transfer channels.

Figure 7:
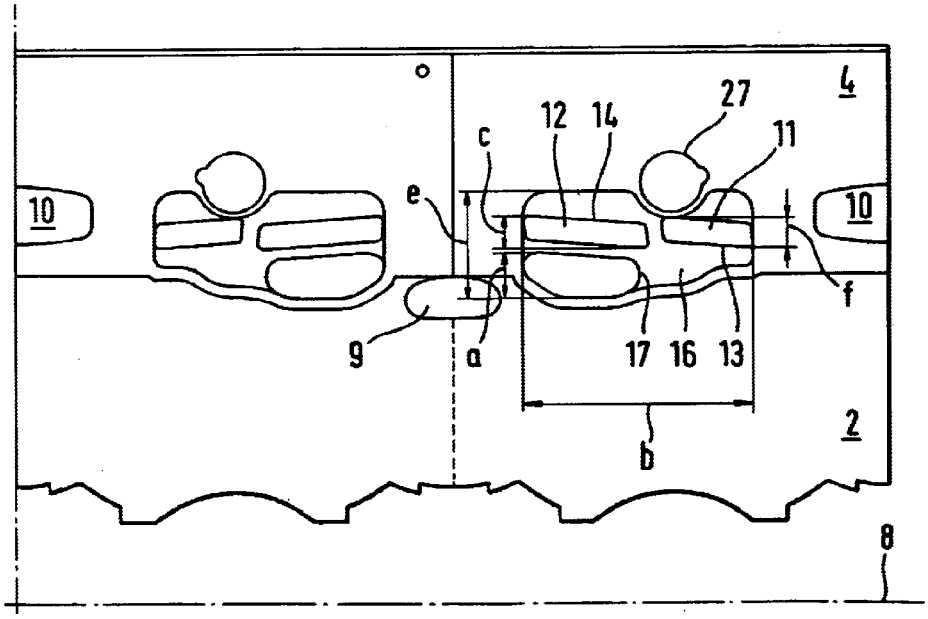
FIG. 7 is a developed view of a cylinder and piston in the upper dead center position of the piston.

As illustrated in the developed view of FIG. 7, the inlet windows 13,14 of the transfer channels 11,12 are, in the region of the upper dead center position of the piston 4, fluidically connected with the air channel window 17 via the piston window 16. Air flows into the transfer channels 12, 11 via the piston window 16. Upon opening of the transfer channels to the combustion chamber 3 during downward movement of the piston, first previously collected air flows into the combustion chamber 3 out of the transfer channels 11, 12. This air separates the fuel/air mixture that is flowing in form the crankcase 6 from the exhaust gases in the combustion chamber 3, which escape via the outlet 10. In this way, a good scavenging result and low exhaust gas values are achieved. For the scavenging result, the quantity of air previously collected in the transfer channels 11, 12 is critical.

To establish a sufficiently long fluidic connection between the air channel 15 and the transfer channels 11,12, it is provided that the height e of the piston window 16, as measured in the direction of the longitudinal axis of the cylinder, and in the region of the air channel window 17, and in particular the maximum height of the piston window 16, corresponds approximately to two to three times the height a of the air channel window 17. In this connection, the height is respectively the extension in the direction of the longitudinal axis 22 of the cylinder. In a corresponding manner, the width is the extension in the circumferential direction relative to the longitudinal axis 22 of the cylinder. The height c of the inlet window 14, and the height f of the inlet window 13, are approximately 10 to 50%, especially 25 to 35%, of the height e of the piston window 16 in the region of the air channel window 17. In the vicinity of the piston collar 27, on which the connecting rod 5 is mounted in the piston 4, the piston window 16 has a lesser height, since the piston collar 27 is partially spanned by the piston window 16. The air channel window 17 is expediently displaced below the inlet window 14, i.e. in a direction toward the crankshaft axis 8. This results in particularly short flow paths and favorable flow conditions.

The uniform course of the flow direction from the inlet 29 to the outlet 30 illustrated in FIG. 3 advantageously exists in a wide range of the piston positions in which the air channel 15 and the transfer channels 11 and 12 are fluidically connected.

FIG. 4 schematically illustrates a modified embodiment. The transfer channels 11 and 12 are illustrated in perspective. The air channel 15 is divided, in the region of the non-illustrated cylinder 2, into two branches 15', 15", each of which is spanned by a transfer channel 12 and, via a non-illustrated piston window 16, is fluidically connected with the transfer channels 12, 11 in specific positions of a piston 4. The air channel branches 15', 15" are curved uniformly.

FIG. 5 illustrates a further embodiment, whereby merely the intake channel 20 with the inlet 9, and the air channel 15 are illustrated. The air channel 15 extends below the intake channel 20 and, in the region of the cylinder, which is not illustrated in FIG. 5, is divided into two branches 15' and 15", which respectively open into the interior of the cylinder 2 via an air channel window 17. The transfer channels 11 and 12 are merely indicated by a sectional area.

The specification incorporates by reference the disclosure of German priority document DE 102 23 070.6 filed 24 May 2002.

The present invention is, of course, in no way restricted to the specific disclosure of the specification and drawings, but also encompasses any modifications within the scope of the appended claims.

We claim:

1. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, wherein a direction of flow in said clean air path extends uniformly from an inlet into said cylinder to an outlet out of said piston window, in at least one position of said piston, and in a plane that extends perpendicular to a longitudinal axis of said cylinder, and wherein a width of said piston window, as measured in a circumferential direction, is 50 to 95% of a diameter of said piston.

2. A two-cycle engine according to claim 1, wherein a change of said direction of flow in said clean air path from said inlet into said cylinder to said outlet out of said piston window extends uniformly in a plane that extends perpendicular to said longitudinal axis of said cylinder.

3. A two-cycle engine according to claim 1, wherein said clean air path from said inlet of said cylinder to said outlet out of said piston window, in at least one piston position, is curved in one direction in a plane that extends perpendicular to said longitudinal axis of said cylinder.

4. A two-cycle engine according to claim 3, wherein a radius of curvature of said clean air path from said inlet into said cylinder to said outlet out of said piston window, in at least one piston position, is approximately constant in a plane that extends perpendicular to said longitudinal axis of said cylinder.

5. A two-cycle engine according to claim 1, wherein two piston windows are disposed symmetrically relative to a central plane, and wherein said central plane approximately centrally divides said inlet and said outlet.

6. A two-cycle engine according to claim 5, wherein two first transfer channels are provided near said outlet, and two second transfer channels are provided remote from said outlet, and wherein said first and second transfer channels are disposed symmetrically relative to said central plane.

7. A two-cycle engine according to claim 1, wherein said piston window has a rear wall that extends parallel to said longitudinal axis of said cylinder.

8. A two-cycle engine according to claim 1, wherein in at least one piston position, in a plane that extends perpendicular to said longitudinal axis of said cylinder, a wall of a portion of said clean air path that is formed in said cylinder merges tangentially into a rear wall of said piston window.

9. A two-cycle engine according to claim 1, wherein an overall volume of said piston window is 4 to 14% of a piston displacement of said two-cycle engine.

10. A two-cycle engine according to claim 1, wherein a resistance to flow from said inlet into said cylinder to said inlet window of said at least one transfer channel is approximately constant in at least one position of said piston.

11. A two-cycle engine according to claim 1, wherein a rear wall of said piston window that is contiguous to said longitudinal axis of said cylinder has a concave configuration in a circumferential direction of said piston.

12. A two-cycle engine according to claim 11, wherein said rear wall of said piston window has a radius of curvature that is at least 70% of a diameter of said piston.

13. A two-cycle engine according to claim 12, wherein said radius of curvature of said rear wall of said piston window is one to nine times said diameter of said piston.

14. A two-cycle engine according to claim 1, wherein a depth of said piston window is 10 to 25% of a diameter of said piston.

15. A two-cycle engine according to claim 1, wherein a height of said inlet window of said at least one transfer channel is 10 to 50% of said height of said piston window in the vicinity of said window of said air channel.

16. A two-cycle engine according to claim 1, wherein two air channels are provided and lead to said cylinder, wherein in a direction of flow, and at a level of a carburetor, said air channels extend in a skewed manner relative to one another.

17. A two-cycle engine according to claim 1, wherein said air channel is provided with a flow control element that, as viewed in a direction of flow, is disposed approximately at a level of a carburetor.

18. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, wherein a direction of flow in said clean air path extends uniformly from an inlet into said cylinder to an outlet out of said piston window, in at least one position of said piston, and in a plane that extends perpendicular to a longitudinal axis of said cylinder, wherein two piston windows are disposed symmetrically relative to a central plane, wherein said central plane approximately centrally divides said inlet and said outlet, wherein two first transfer channels are provided near said outlet, and two second transfer channels are provided remote from said outlet, and wherein said first and second transfer channels are disposed symmetrically relative to said central plane.

19. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, wherein a direction of flow in said clean air path extends uniformly from an inlet into said cylinder to an outlet out of said piston window, in at least one position of said piston, and in a plane that extends perpendicular to a longitudinal axis of said cylinder, and wherein said air channel is provided with a flow control element that, as viewed in a direction of flow, is disposed approximately at a level of a carburetor.

20. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, wherein a direction of flow in said clean air path extends uniformly from an inlet into said cylinder to an outlet out of said piston window, in at least one position of said piston, and in a plane that extends perpendicular to a longitudinal axis of said cylinder, and wherein a height of said piston window, in the vicinity of a window of said air channel, via which air channel window a portion of said clean air path opens into said cylinder, is two to three times a height of said window of said air channel.

21. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, wherein a direction of flow in said clean air path extends uniformly from an inlet into said cylinder to an outlet out of said piston window, in at least one position of said piston, and in a plane that extends perpendicular to a longitudinal axis of said cylinder, wherein said air channel leads from an air filter to said cylinder, wherein in the region of said cylinder said air channel is divided into two branches, and wherein a direction of flow in each branch of said air channel extends approximately tangential to the direction of flow in the cooperative portion of said air channel.

22. A two-cycle engine, comprising:

a cylinder in which is formed a combustion chamber that is delimited by a reciprocating piston that, via a connecting rod, drives a crankshaft that is rotatably mounted in a crankcase, wherein an inlet is provided for a supply of fuel/air mixture into said crankcase, wherein an outlet is provided for a discharge of exhaust gas from said combustion chamber, wherein at least one transfer channel is provided for fluidically connecting said crankcase with said combustion chamber in prescribed positions of said piston, wherein said at least one transfer channel opens into said combustion chamber via an inlet window, wherein a clean air path is provided that includes an air channel, a piston window and said at least one transfer channel, wherein said air channel serves for conveying essentially fuel-free air and, in prescribed positions of said piston, is fluidically connected via said piston window with said inlet window of said at least one transfer channel, and wherein a rear wall of said piston window is formed from adjoining partial sections having different radii of curvature.

* * * * *